US010004303B1

(12) United States Patent
DeRennaux

(10) Patent No.: US 10,004,303 B1
(45) Date of Patent: Jun. 26, 2018

(54) CUSTOMIZABLE BRACELET

(71) Applicant: Rick DeRennaux, Moore, OK (US)

(72) Inventor: Rick DeRennaux, Moore, OK (US)

(73) Assignee: Nauxware, LLC, Oklahoma City, OK (US)

( * ) Notice: Subject to any disclaimer, the term of this patent is extended or adjusted under 35 U.S.C. 154(b) by 0 days. days.

(21) Appl. No.: 13/953,361

(22) Filed: Jul. 29, 2013

Related U.S. Application Data

(60) Provisional application No. 61/676,931, filed on Jul. 28, 2012, provisional application No. 61/681,994, filed on Aug. 10, 2012.

(51) Int. Cl.
*A44C 5/00* (2006.01)
*A41F 9/00* (2006.01)

(52) U.S. Cl.
CPC ..... *A44C 5/0007* (2013.01); *A41F 9/00* (2013.01)

(58) Field of Classification Search
CPC ..... A44C 5/00; A44C 5/0007; A44C 17/0208; A44C 13/00; A44C 15/00; A44C 15/0035; A44C 25/00; A44C 25/008; A44C 17/0216; A44C 17/0233; A41F 9/002; A41F 9/00; A41D 27/08; A43B 3/0078; A01K 27/006
USPC ..... 63/40, 3–3.2; 2/338; 36/136; 119/856
See application file for complete search history.

(56) References Cited

U.S. PATENT DOCUMENTS

| | | | | |
|---|---|---|---|---|
| 3,708,804 | A | 1/1973 | Santos | |
| 3,848,270 | A | 11/1974 | Rand | |
| 4,247,219 | A * | 1/1981 | Ausprung | F16B 5/10 24/453 |
| 4,521,923 | A | 6/1985 | Mackey | |
| D344,624 | S | 3/1994 | Schnel | |
| 5,852,829 | A | 12/1998 | Relaford | |
| 6,012,203 | A | 1/2000 | Baron Pearson | |
| 6,422,177 | B1 | 7/2002 | Noguero | |
| 6,691,533 | B2 * | 2/2004 | Feuer | 63/26 |
| 6,880,364 | B1 * | 4/2005 | Vidolin et al. | 63/40 |
| D592,097 | S | 5/2009 | Androuais | |
| 7,698,836 | B2 * | 4/2010 | Schmelzer et al. | 36/136 |
| 8,112,963 | B2 | 2/2012 | Johnson | |
| 8,122,519 | B2 | 2/2012 | Schmelzer | |
| 8,763,163 | B1 * | 7/2014 | Johns | 2/200.1 |
| 2005/0150034 | A1 | 7/2005 | Marks | |
| 2006/0162051 | A1 | 7/2006 | Bachechi | |
| 2006/0283402 | A1 * | 12/2006 | Smith et al. | 119/863 |
| 2007/0094776 | A1 | 5/2007 | Stevens | |
| 2008/0060110 | A1 * | 3/2008 | Schmelzer | A42B 1/24 2/69 |
| 2008/0245048 | A1 | 10/2008 | Moore | |
| 2010/0107310 | A1 | 5/2010 | Taylor | |
| 2012/0144562 | A1 | 6/2012 | Ferrara | |
| 2013/0117987 | A1 * | 5/2013 | Rienecker | 29/428 |

* cited by examiner

*Primary Examiner* — Abigail Morrell
(74) *Attorney, Agent, or Firm* — Muskin and Farmer LLC

(57) ABSTRACT

A customizable bracelet or belt that has a matrix of evenly spaced holes all around the article. Inserts such as pegs, rhinestones, and charms are configured to be inserted through any of the holes and will be snugly secured inside the hole. In this way, a very large number of configurations can be designed by a user by using different combinations of the inserts. The configurations can be in a particular pattern, spell words, etc.

12 Claims, 7 Drawing Sheets

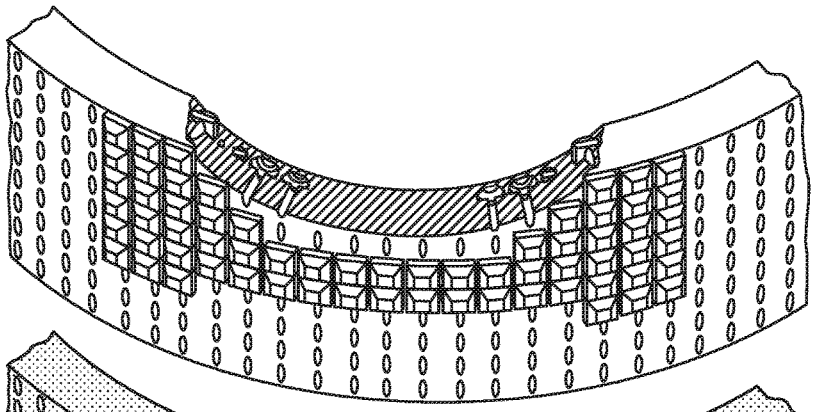
FIG. 7A
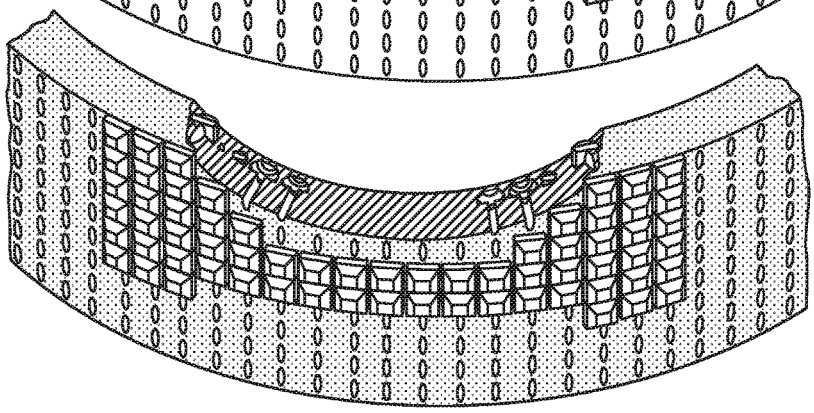
FIG. 7B
FIG. 8A
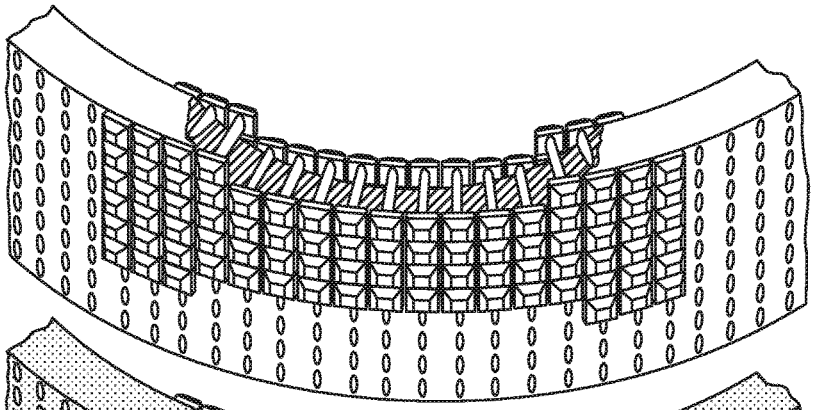
FIG. 8B
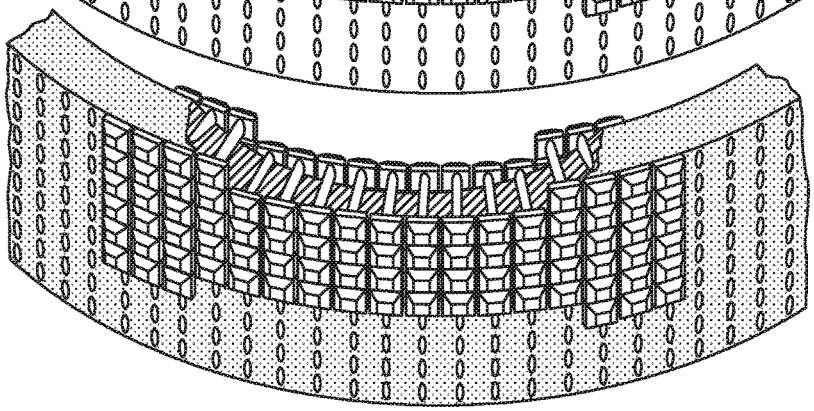

CUSTOMIZABLE BRACELET

CROSS REFERENCES TO RELATED APPLICATIONS

This application claims benefit to U.S. provisional application 61/676,931, which is incorporated by reference herein in its entirety. This application also claims benefit to U.S. provisional application 61/681,994, which is incorporated by reference herein in its entirety.

BACKGROUND OF THE INVENTION

Field of the Invention

The present general inventive concept is directed to a customizable bracelet and a method for customizing the customizable bracelet.

SUMMARY OF THE INVENTION

It is an aspect of the present invention to provide a customizable bracelet.

The above aspects can be implemented using a method that includes (a) providing: an article of clothing with a matrix of holes, the article being made from a deformable material; a plurality of inserts, each insert comprising a tail piece, a decorative element, and a shaft connecting the tail piece to the decorative element, each of the plurality of inserts configured to squeeze inside each of holes in the article thereby forming a snug fit; and inserting the plurality of inserts into the article of clothing to create a visual design.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 7A is a line drawing of a bracelet configured such that pegs pass entirely through the bracelet, according to an embodiment;

FIG. 7B is a solid model drawing of the bracelet configured such that pegs pass entirely through the bracelet, according to an embodiment;

FIG. 8A is a line drawing of a bracelet configured such that pegs do not pass entirely through the bracelet, according to an embodiment;

FIG. 8B is a solid model drawing of the bracelet configured such that pegs do not pass entirely through the bracelet, according to an embodiment;

DESCRIPTION OF THE PREFERRED EMBODIMENTS

Figures 1A, 1B, 1C, 1D, 1E, 1F, 1G, 1H, 1I, 1J:
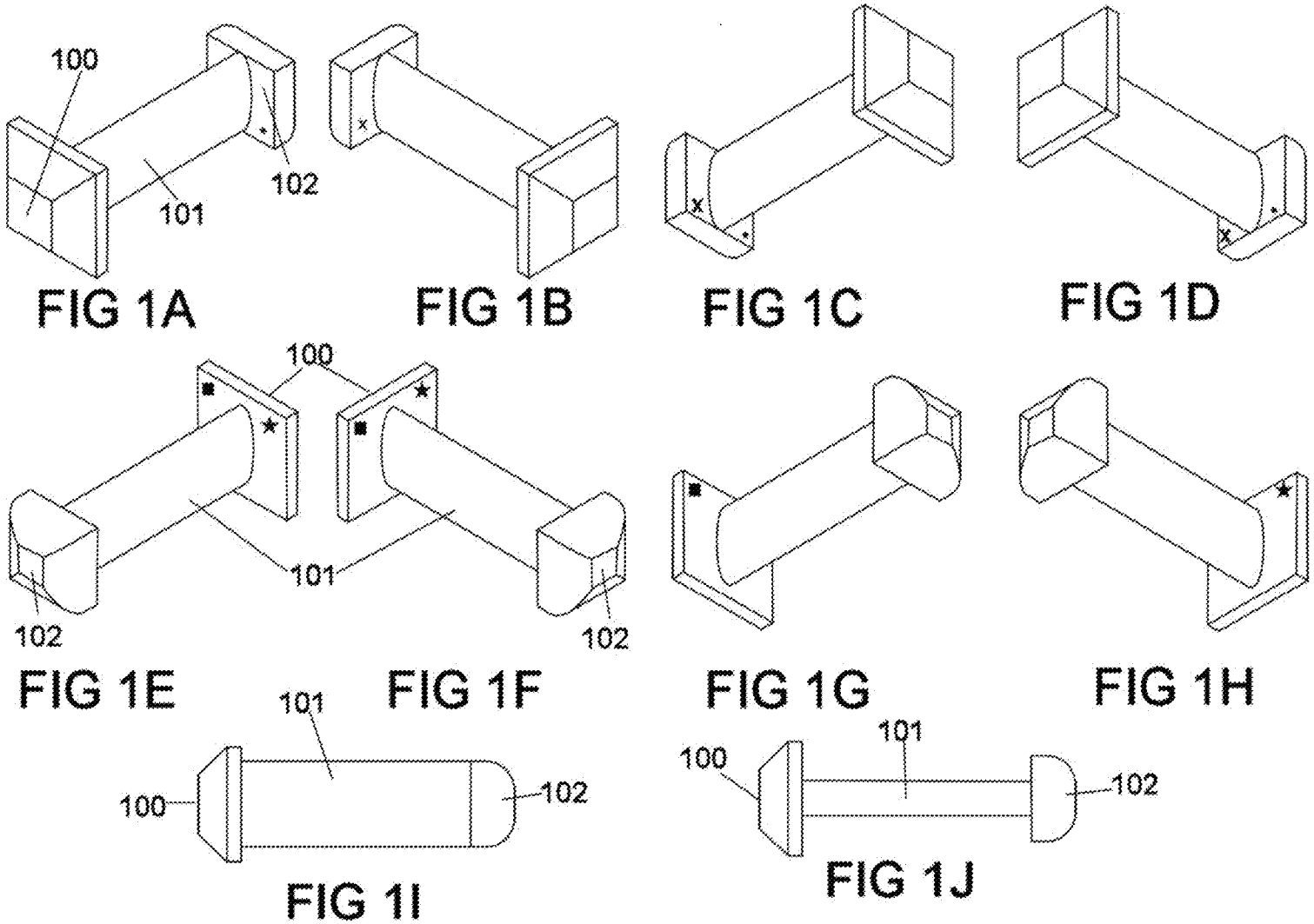
FIGS. 1A, 1B, 1C, 1D, 1E, 1F, 1G, 1H, 1I, and 1J are different views of a peg (also referred to as an insert), according to an embodiment.

Reference will now be made in detail to the presently preferred embodiments of the invention, examples of which are illustrated in the accompanying drawings, wherein like reference numerals refer to like elements throughout.

The present inventive concept relates to a customizable bracelet of the kind illustrated in the attached figures. A bracelet (or other article of clothing such as a belt, patch, etc. can be used interchangeably) can have a matrix (holes located in both axes) throughout the article. The holes are typically evenly spaced (although they are not required to be). The holes would also be located throughout the article, for example in the illustrated bracelet, the matrix of evenly spaced holes continuously wraps around the entire bracelet (including the parts of the bracelet that are not visible in the figure) without any part of the bracelet not having its respective hole(s). In other words, the parts of the bracelet that are not visible are identical to the parts that are visible, as the pattern of holes remains the same through the bracelet (and other article of clothing such as a belt). A bracelet can be constructed from a flat surface that has the holes as described herein. For example, see the figure with the caption "a blank patch" which shows the matrix of identically shaped, uniform, evenly spaced holes in both dimensions. This patch can be "rolled up" to form a bracelet which can then be glued (or other attachment mechanism) at the ends to form a round bracelet (or belt).

Inserts (also referred to as pegs or posts) are pieces that are configured to snap into any one of the holes. A kit can be sold which includes at least one of the articles of clothing (e.g., bracelet) and an assortment of inserts with a variety of decorative elements (different charms, different jewels, different colors, etc.) that can be place inside holes in the article of clothing. A large number of inserts would be included (e.g., 10 to 1000 or more). All inserts in the kit can be different (e.g., different colors, shapes, etc.) or some can be identical. All the inserts included in the kit can be as described herein, even though they all need not be identical.

FIGS. 1A, 1B, 1C, 1D, 1E, 1F, 1G, 1H, 1I, and 1J are different views of a peg (also referred to as an insert), according to an embodiment. The decorative element 100 is connected to shaft 101 which is connected to a shaft 101 which is connected to a tail piece 102. The markings on the tail piece 102 are shown just to show the orientations.

FIGS. 1A, 1B, 1C, 1D show the decorative element 100 in front while FIGS. 1E, 1F, 1G, 1H should the tail piece 102 in front. The markings on the decorative element are shown just to show the orientations.

FIG. 1I shows a side view (either side is the same) and FIG. 1J shows the top and bottom (both the same).

In FIGS. 1A to 1I the shaft is shown to be an oval shape extended along the length of the shaft. In other words, start with a two-dimensional oval and extend the oval in three-dimensions to create a three dimensional "thick" oval. One advantage of using an oval shape for the shaft is that the oval shape will not rotate when inserted into a hole in the article (e.g., bracelet, belt, patch, etc.) In additional to an oval shape, other shapes can be used as well, such as "plus sign" shape, square, rectangle, round, or any other shape. Of course, all of the holes in the article must have the same shape as well (e.g., an oval shape for an oval shaft, a plus sign shape for a plus sign shaped shaft, etc.) so that the tail piece and shaft can be inserted into each hole in the article.

The decorative element can be a charm, rhinestone, solid color, a chain, etc. The decorative element can also be made from glow in the dark material. Inserts can be included in the kit that have numerous decorative elements of different appearances, colors (the decorative elements in the kit can of any number of different colors such as 2 to 10 or more), shapes, etc. Some decorative elements would have a uniform square shape (which can come in any number of different colors such as 2 to 10 or more) so that they can be used to write words or form designs.

The tail piece is made from deformable (malleable, stretchable) material which can include (but not limited to) soft plastic, Styrofoam, rubber, silicone, leather (real or imitation), fabrics, cotton, etc. When the tail piece is pressed up against a hole, even though the tail piece is greater in physical size than the hole, because it is deformable, it can squeeze (deform) and thus fit inside the hole. When the insert is inserted completely through a hole, the tail piece will be pressed through the other size of the hole in which it is no longer deformed and reverts to its full size, thereby securing the insert inside the hole. Thus, when inserted, the tail piece is located completely outside of its hole. Inserts can be removed by pulling the decorative element out of the article (which would cause the tail piece to deform again and fit through the hole). The shaft is typically not deformable (although in another embodiment it can be). The decorative element is typically not deformable (although in another embodiment it can be). The tail piece and/or shaft and/or decorative element can also be made of a hard material (e.g., plastic, wood, etc.) which is not deformable/stretchable. If the article is made from a deformable material then there is no need for the insert to also be deformable.

When an insert is placed inside a hole, the shaft of the insert is located through the hole. In one embodiment, the shaft can be shaped in a plus sign, and the holes in the article can also be shaped in a plus sign, thus the shaft shape is adapted to snugly fit inside each hole. Using a plus sign shape, the shaft is prevented from rotation, and thus the decorative elements attached to the shaft are also prevented from rotating as well, thus providing a stable design. The shaft (e.g., plus-shaped) should of course be adapted in size and shape to cooperate with the holes (e.g., plus-shaped) in order that the shaft (and hence the insert) can fit snugly inside the hole.

In other embodiments, other shapes for the holes and shafts can be used as well (the holes and the shafts should be designed to cooperate with one another). For example, a bracelet can have all round holes and the shafts on all of the inserts can all be round. The shafts and cooperating holes can also be rectangular, oval-shaped, square, etc. All of the holes in the article of clothing should typically be identical in shape, and all of the shafts and tail pieces out of all of the inserts should also typically be identical in shape (but not necessarily appearance).

In a further embodiment, instead of the tail piece being made from deformable (malleable, stretchable) material, the material of the article of clothing itself (bracelet, belt, patch, etc.) is made from deformable (stretchable) material (such as silicone, natural rubber, synthetic rubber, silicone rubber, synthetic leather, etc.) and thus the tail piece (and shaft) would not have to be made from deformable material. The entire article can be made from the deformable material or just the portions of it which comprise the holes. For example, the material of the belt or bracelet has deformable/stretchable properties so that the holes would expand (because the surrounding portion of the belt/bracelet itself would stretch) when the tail piece/shaft is pressed through the hole (the material of the belt/bracelet would also stretch when pulled apart using a small force). In this way, the entire insert (tail piece, shaft, decorative element) does not have to be malleable/deformable/stretchable at all and can be completely firm. Once the insert is placed through the hole and inside the article, the nature of the deformable material that the entire article is made from is to contract a little and thus surround the insert with a snug fit. Because the shape of the tail piece is tetrahedral (pyramid shaped), when inserted into a hole in the bracelet it would encourage that portion of the bracelet/belt to stretch and thus accept the insert.

Any materials and any dimensions for the article, holes, inserts can be used. For the inserts, the decorative element (also referred to as decorative head) can be 2 millimeters or can range from 1 to 4 millimeters or any other size can be used. While any dimensions for the individual parts can be used, one set of dimensions that can be used is the height of the shaft can be 4 millimeters, the tail piece 2 millimeters, and the decorative element (head) 2 millimeters (for a total of 8 millimeters). The bracelet may get too thick over 12 millimeters thick.

Figure 2:
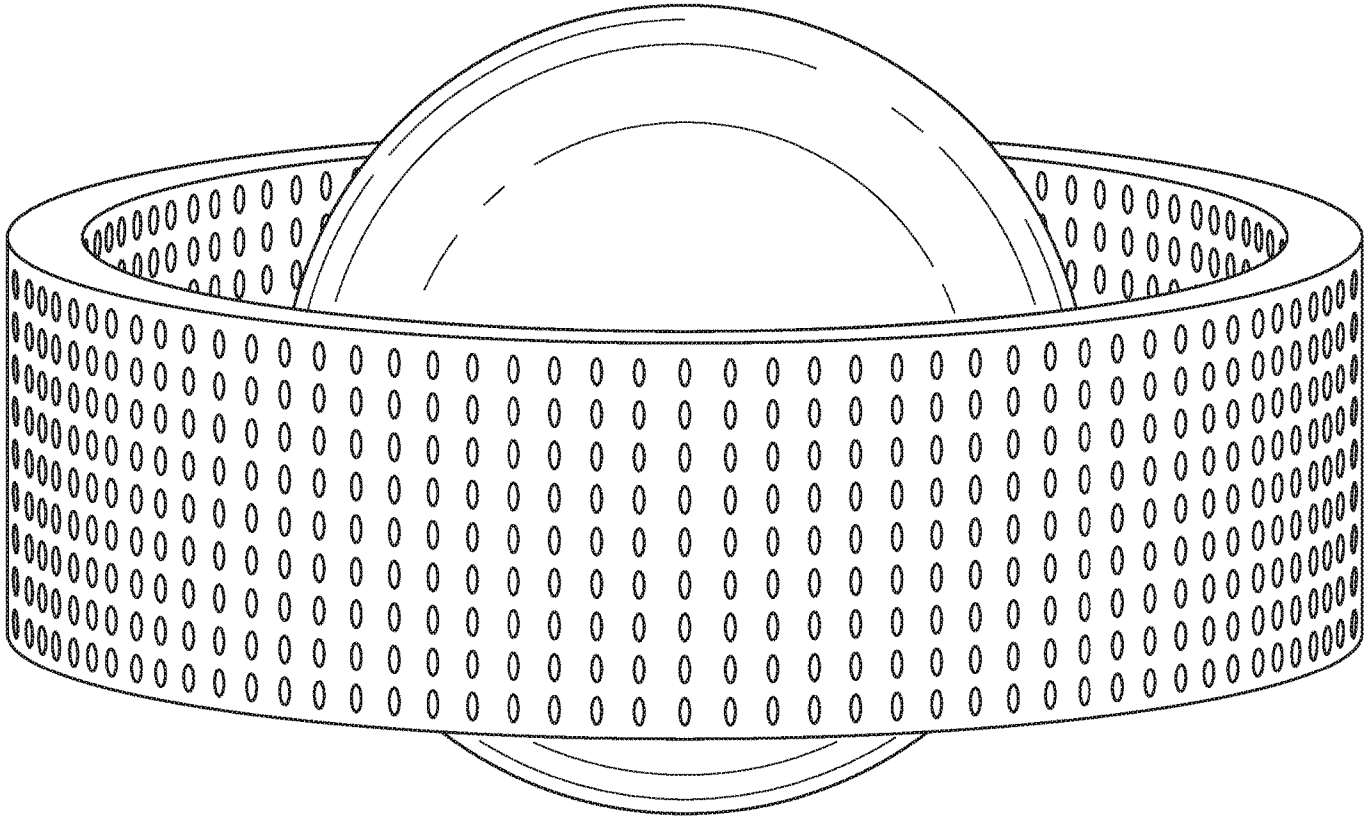
FIG. 2 is a drawing of a bracelet, according to an embodiment.

FIG. 2 is a drawing of a bracelet, according to an embodiment. The marble shown in the center is not part of the invention and is merely shown to help illustrate the bracelet and how the holes go entirely through the article.

Note that the holes in the bracelet (or any article) are evenly spaced and are throughout the entire article. Note that for the parts of the bracelet that are not visible in FIG. 2, the holes are positioned in the exact same manner as what is visible (e.g., evenly spaced throughout the entire bracelet with no gap in holes).

In an embodiment, the bracelet can come already formed in a round shape (e.g., the bracelet is molded in that shape). In another embodiment, the bracelet (or other circular article) can come in a flat shape and then can be closed (both ends connected) with a hasp or magnetic apparatus. For example, two small magnets on one end of the bracelet can snap to (are attracted to) a metal bar on the opposite edge of the open bracelet, Or, two magnets on one end of the bracelet that would snap to (are attracted to) opposite magnets on the other end of the bracelet thus closing and locking the bracelet together.

Figure 3:
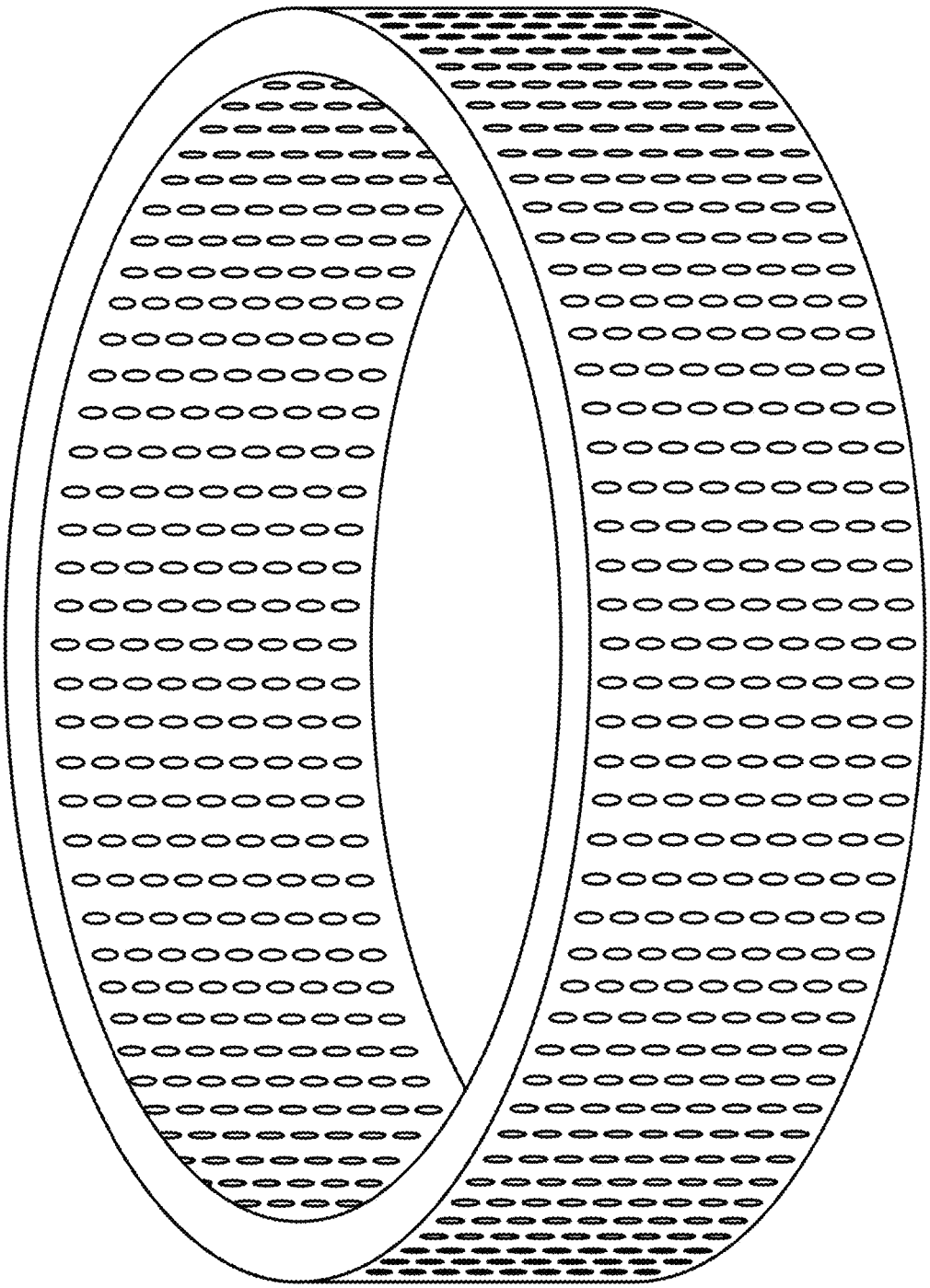
FIG. 3 is a further drawing of a bracelet, according to an embodiment.

FIG. 3 is a line drawing of a bracelet, according to an embodiment. The holes surround the entire article (bracelet) with no break in the continuous holes that are present throughout the article. Thus, there is no real "start" and "end" of the bracelet since the holes are continuously throughout the bracelet.

Figure 4A:
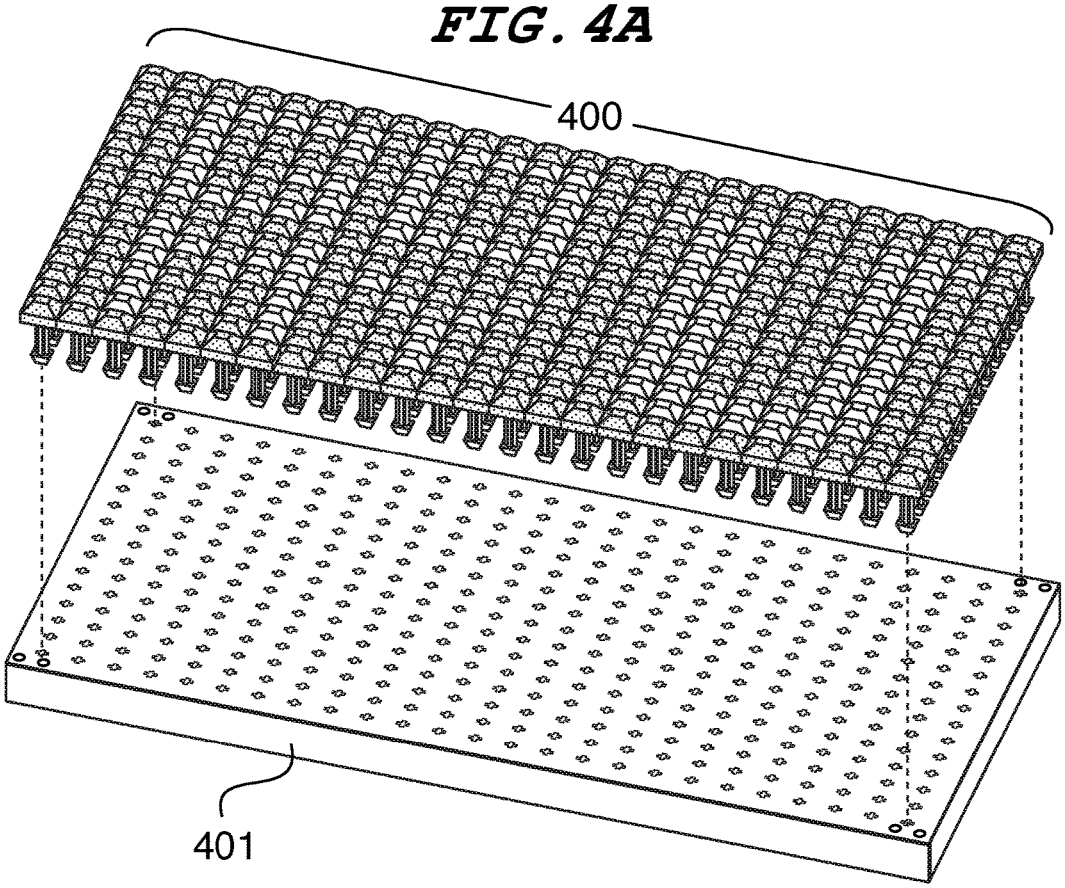
FIG. 4A is a drawing of a patch and a set of inserts adapted to be inserted into the patch, according to an embodiment.

FIG. 4A is a drawing of a patch and a set of inserts adapted to be inserted into the patch, according to an embodiment.

A set of inserts (pegs) 400 is shown. Note that the inserts typically do not stick together and there is nothing to keep them together if not placed into the article 401 of clothing. The inserts 400 are just shown in this manner in FIG. 4A for illustrative purposes. The article of clothing 401 can be a patch or other article. Note the holes in the article 401 are uniformly (evenly) spaced throughout the article and cover the entire article (no gaps in holes exist anywhere on the article).

Figure 4B:
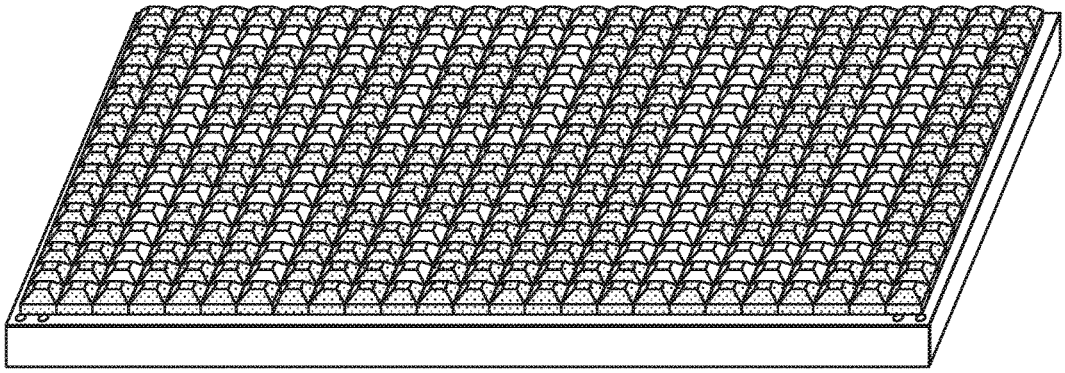
FIG. 4B is a drawing of the inserts inserted into the patch, according to an embodiment.

FIG. 4B is a drawing of the inserts inserted into the patch, according to an embodiment.

The inserts 400 are inserted into the patch 401 thereby creating a customized patch which can display messages, artwork, etc.

Figure 5:
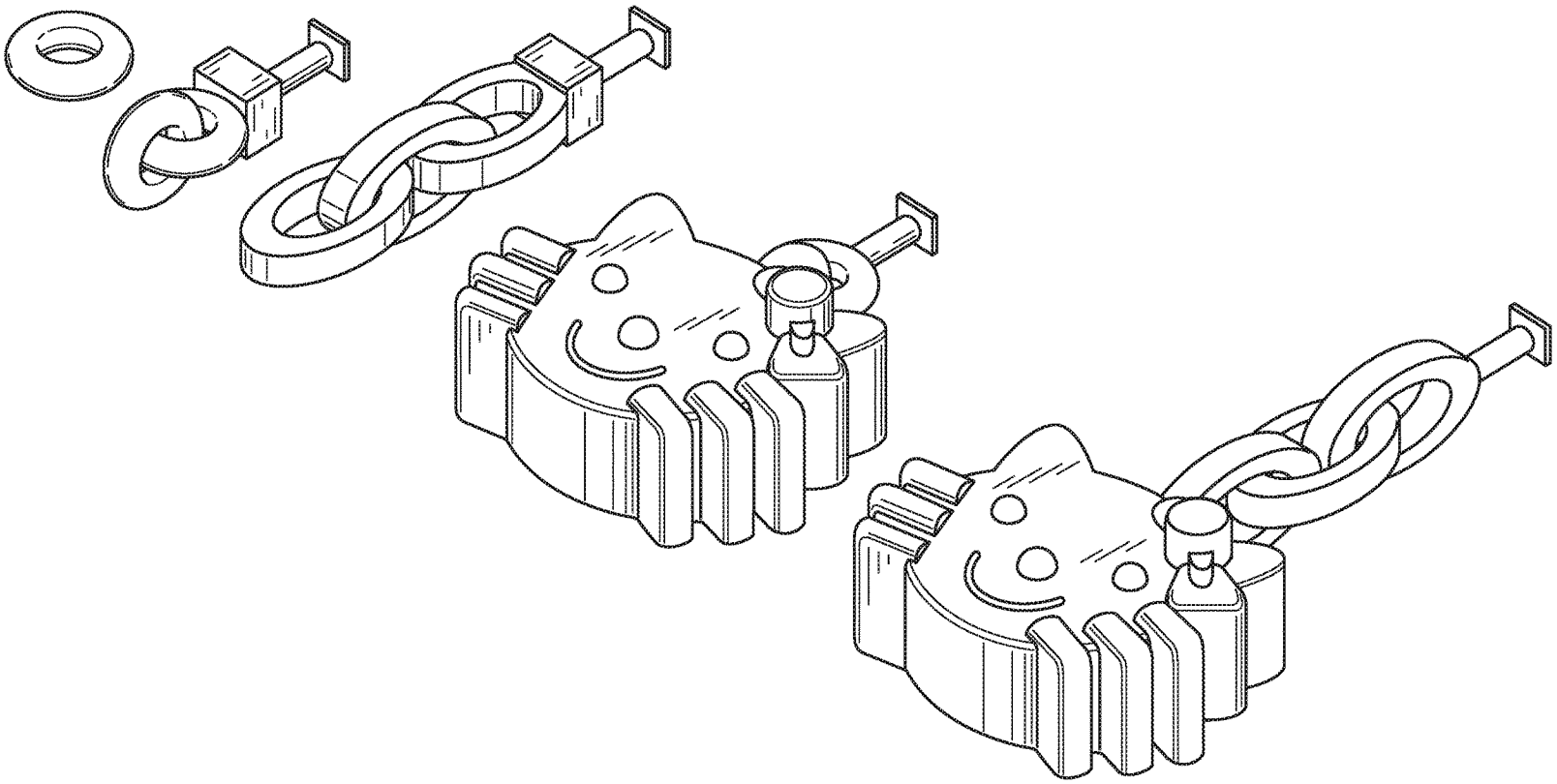
FIG. 5 is a drawing of a number of exemplary decorative elements that can be attached to a peg, according to an embodiment.

FIG. 5 is a drawing of a number of exemplary decorative elements that can be attached to a peg, according to an embodiment. All of the items shown are attached to the decorative element which is connected to the shaft.

Figure 6:
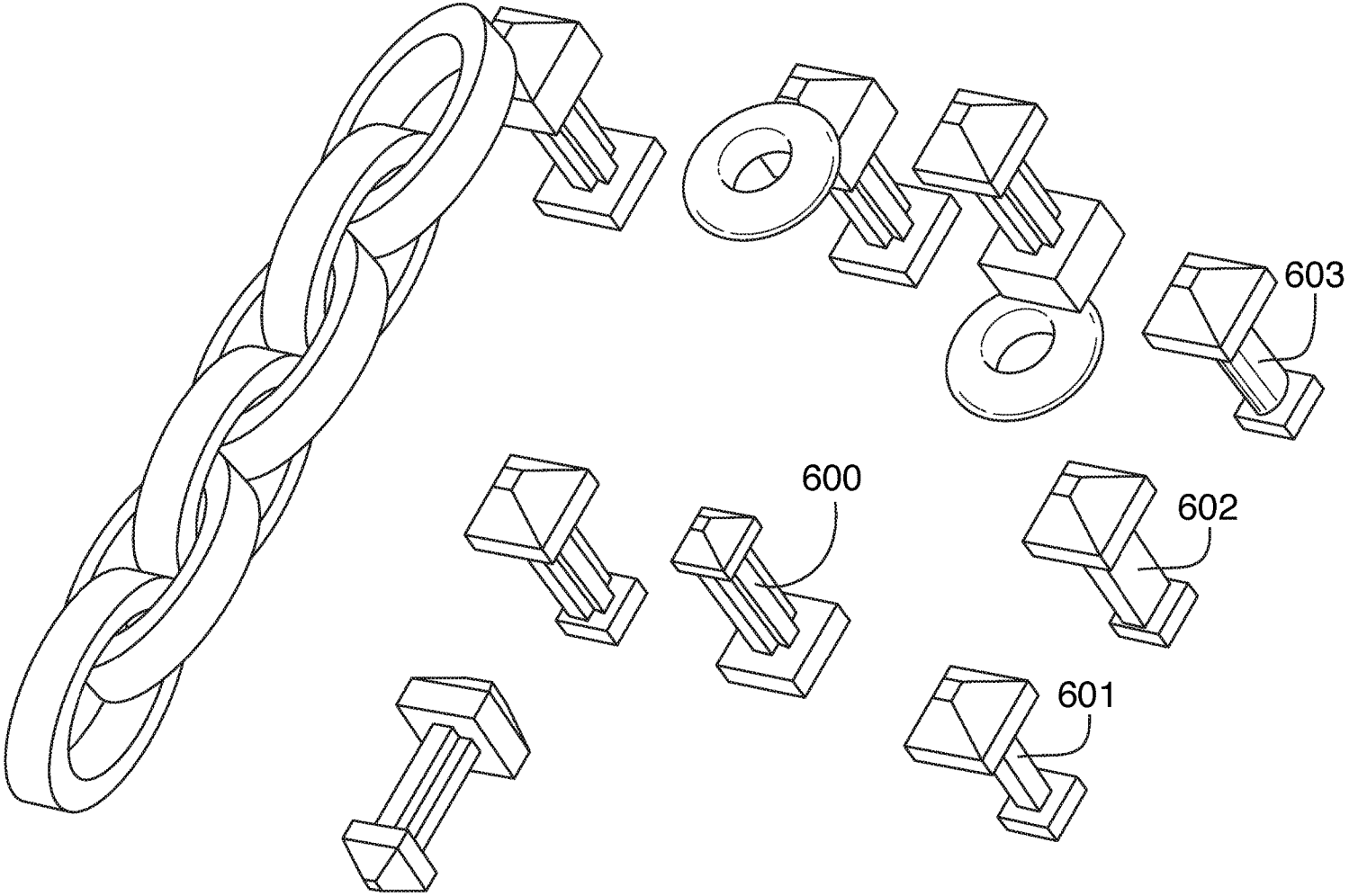
FIG. 6 is a drawing of a plurality of different shaped peg shafts, according to an embodiment.

FIG. 6 is a drawing of a plurality of different shaped peg shafts, according to an embodiment.

Note that different shaped shafts are shown, such as a plus shaped shaft 600, a square shaft 601, a rectangular shaft 602, and an oval shaped shaft 603. Of course, the holes in the article must match this shape so that the tail piece and shaft can fit through and be snugly secured therein.

FIG. 7A is a line drawing of a bracelet configured such that pegs pass entirely through the bracelet (or other article), according to an embodiment. As can be seen in FIG. 7A, the tail shaft passes through the hole in the bracelet and the tail piece sticks out the opposite end of the bracelet than the decorative element. In order to insert a peg, the tail piece is pressed through a hole, as typically the decorative element is not big enough to pass through the hole in the bracelet. Thus on the inner surface of the bracelet (touching the wearer's wrists), the tail pieces would all be visible. The outer surface of the bracelet (which has the decorative elements and visible to the public) would show any unique design made by the wearer (user).

FIG. 7B is a solid model drawing of the bracelet configured such that pegs pass entirely through the bracelet, according to an embodiment.

In another embodiment, the tail piece does not have to pass entirely through the bracelet (or other article) and can rest inside the bracelet (without coming out the inner surface).

FIG. 8A is a line drawing of a bracelet configured such that pegs do not pass entirely through the bracelet, according to an embodiment. Note that the tail pieces all rest inside the bracelet (or other article) and are not visible from the inner surface of the bracelet.

FIG. 8B is a solid model drawing of the bracelet configured such that pegs do not pass entirely through the bracelet, according to an embodiment.

It is noted that in one embodiment, the tail piece of the inserts (also referred to as pegs) can be deformable in order to squeeze through its respective hole in the article. The article can be made of deformable material (e.g., rubber, silicon, synthetic leather, etc.) or it can be made of non-deformable material (e.g., hard plastic, etc.) The shaft can also be deformable (or not be deformable). Deformable means made of a material which can be stretched and compressed such as rubber, silicon, synthetic leather, etc.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention. Any feature described herein can be combined and used with any other feature without limitation. Any part mentioned herein can be made from any material mentioned herein (e.g., wood, plastic, rubber, synthetic rubber, silicone rubber, natural rubber, silicone, fabric, metal, etc.)

What is claimed is:

1. An apparatus, comprising:

an article of clothing with a matrix of holes, the article being made from a deformable material; and a plurality of inserts, each insert out of the plurality of inserts comprising: a tail piece, a decorative element, and a shaft connecting the tail piece to the decorative element, the shaft being of uniform size and shape from the tail piece to the decorative element, the tail piece comprises a rectangular cuboid portion which is wider and longer than the shaft, the tail piece also comprising a truncated square pyramid shaped protrusion adjacent to the rectangular cuboid portion, the truncated square pyramid shaped protrusion being aligned with the shaft with a smaller end of the truncated square pyramid shaped protrusion pointing opposite the decorative element, the decorative element being wider and longer than the tail piece, wherein the tail piece and the shaft being configured to fit inside the holes in the article and the decorative element is configured not to fit inside the holes in the article.

2. The apparatus as recited in claim 1, wherein the article is a belt.

3. The apparatus as recited in claim 1, wherein the article is a circular bracelet.

4. The apparatus as recited in claim 1, wherein the article is a patch.

5. The apparatus as recited in claim 1, wherein the holes are evenly spaced.

6. The apparatus as recited in claim 1, wherein the holes are located along the entire length and width of the article surrounded by the deformable material.

7. The apparatus as recited in claim 6, wherein all of the holes are evenly spaced.

8. The apparatus as recited in claim 1, wherein the decorative element is one of a charm, rhinestone, a chain, and a solid color.

9. The apparatus as recited in claim 1, wherein the plurality of inserts comprises A charms, B rhinestones, C chains, and D solid colors, wherein A, B, C, D can each be any number from 0 to 1000.

10. The apparatus as recited in claim 1, wherein the matrix of holes is 10 holes by 10 holes.

11. The apparatus as recited in claim 1, wherein the matrix of holes is greater than 10 holes by greater than 10 holes.

12. The apparatus as recited in claim 1, wherein each of the plurality of inserts has a respective decorative element of a different color.

* * * * *